US005233144A

United States Patent [19]

Morino et al.

[11] Patent Number: 5,233,144

[45] Date of Patent: Aug. 3, 1993

[54] HEAT GENERATING CONTAINER FOR MICROWAVE OVEN

[75] Inventors: Taisuke Morino, Suita; Mami Tanaka, Yao; Fuminori Kaneko; Shuichi Akiyama, both of Matsubara, all of Japan

[73] Assignee: Sharp Kabushiki Kaisha, Osaka, Japan

[21] Appl. No.: 659,775

[22] Filed: Feb. 25, 1991

Related U.S. Application Data

[62] Division of Ser. No. 363,137, Jun. 8, 1989, Pat. No. 5,019,680.

[30] Foreign Application Priority Data

Jun. 14, 1988 [JP] Japan ..... 63-78980
Jun. 14, 1988 [JP] Japan ..... 63-78981
Jun. 15, 1988 [JP] Japan ..... 63-149052
Jun. 28, 1988 [JP] Japan ..... 63-86401

[51] Int. Cl.[5] ..... H05B 6/80

[52] U.S. Cl. ..... 219/10.55 E; 219/10.55 F; 219/10.55 R; 99/DIG. 14; 99/328; 426/112; 426/232; 426/243

[58] Field of Search ..... 219/10.55 E, 10.55 F, 219/10.55 R; 99/DIG. 14, 426, 328, 326; 426/243, 113, 118, 27, 19, 549, 232, 112, 120, 124; 220/4.21, 4.24, 23.2

[56] References Cited

U.S. PATENT DOCUMENTS 2,622,187 12/1952 Welch ..... 99/DIG. 14
3,780,642 12/1973 Bay ..... 99/347
3,835,281 9/1974 Mannix ..... 219/10.55 E
3,862,339 1/1975 Balboni ..... 426/19
4,027,132 5/1977 Levinson ..... 219/10.55 F
4,216,241 8/1980 Thompson ..... 426/27
4,267,420 5/1981 Brastad ..... 219/10.55 E
4,398,077 8/1983 Freedman et al. ..... 219/10.55 E
4,454,403 6/1984 Teich et al. ..... 219/10.55 E
4,456,805 6/1984 Jorgensen et al. ..... 219/10.55 F
4,499,356 2/1985 Hatagawa ..... 219/10.55 E
4,563,561 1/1986 Vaeth et al. ..... 219/10.55 E
4,565,703 1/1986 Garbar et al. ..... 426/232
4,641,005 2/1987 Seiferth ..... 219/10.55 E
4,663,506 5/1987 Bowen et al. ..... 219/10.55 E
4,676,857 6/1987 Scharr et al. ..... 156/233
4,713,510 12/1987 Quick et al. ..... 219/10.55 E
4,778,970 10/1988 Klaila ..... 219/10.55 A
4,803,086 2/1989 Hedenberg ..... 426/87
4,822,966 4/1989 Matsubara ..... 219/10.55 M
4,870,233 9/1989 McDonald et al. ..... 219/10.55 E
5,019,680 5/1991 Morino et al. ..... 219/10.55 E
5,046,659 9/1991 Warburton ..... 220/4.24
5,048,707 9/1991 Hallberg ..... 220/4.21
5,146,840 9/1992 Hedenberg ..... 99/328

FOREIGN PATENT DOCUMENTS 53-36753 5/1978 Japan .
58-52916 3/1983 Japan .
58-52917 3/1983 Japan .
2097639 11/1982 United Kingdom .

*Primary Examiner*—Bruce A. Reynolds
*Assistant Examiner*—Tu Hoang

[57] ABSTRACT

A heat generating container for use in a microwave oven, which includes a metallic main container, a metallic lid to be detachably applied onto said metallic main container, and microwave absorbing heat generating film layers formed on an outer surface of the metallic main container and metallic lid. The microwave absorbing heat generating film layers are varied in thickness for uniform heat generation of the main container and the lid.

20 Claims, 4 Drawing Sheets

HEAT GENERATING CONTAINER FOR MICROWAVE OVEN

This application is a divisional of copending application Ser. No. 07/363,137, filed on Jun. 8, 1989 now U.S. Pat. No. 5,019,680.

BACKGROUND OF THE INVENTION

The present invention generally relates to a high frequency heating arrangement and more particularly, to a heat generating vessel or container for use in a microwave oven which is one example of high frequency heating apparatuses, so as to generate heat through projection of microwaves irradiated from a magnetron (i.e., a high frequency generating means) for heating an object to be cooked, and also for baking thereof.

A microwave oven is a cooking apparatus arranged to guide microwaves emitted from a magnetron into an oven interior or heating chamber for irradiation onto an object to be cooked so as to effect cooking by causing said object itself to generate heat.

However, there are some items to be cooked which are not suitable for direct heating by microwaves such as those requiring scorched portions or those to be subjected to cooking after expediting fermentation by raising temperature thereof.

In order to deal with the cooking items as referred to above, there has been proposed a microwave oven further provided with a sheathed heater in the heating chamber so as to make it possible to subject the item to be cooked to heat treatment through utilization of heat irradiated from said sheathed heater besides the microwave radiation.

In the microwave oven of the above described type, however, since two kinds of heating means, i.e., the magnetron and the sheathed heater, must be provided as heat sources, not only do cost increase, but the construction of the microwave oven is undesirably complicated, with a consequent increase in the size of the apparatus on the whole.

Therefore, in order to overcome the various problems as described above, there has been recently developed a heat generating member composed of a plate in a double layer construction formed by laminating a heat generating substance (e.g., silicon carbide, ferrite or the like) which generates heat through irradiation of microwaves and an inorganic heat insulating base material (e.g., glass, ceramic or the like). There has also been proposed a heat generating member made of a silicon carbide group ceramic molded plate.

The microwave oven employing the heat generating members of the above described type is capable of effecting both the dielectric heating and the heating by heat radiation, only through irradiation of microwaves and is referred to as a multi-function microwave oven.

Incidentally, due to the fact that a so-called "home bakery" or household bread baking unit has recently become a popular article, a microwave oven provided with a bread baking function has been studied and manufactured as an actual commercially available product.

Although a bread baking container or hopper (referred to as a hopper hereinafter) to be disposed in the oven interior or heating chamber of the microwave oven is generally arranged to be heated indirectly, this practice requires parts for subjecting heated air to convection for efficient conduction of heat to the hopper, and thus, not only do cost increase, but power consumption is undesirably raised due to poor heating efficiency, even when the heat is conducted in an efficient manner.

On the other hand, as a direct heating practice, there has conventionally been proposed an arrangement in which a microwave absorbing heat generating material is applied over an outer surface of a hopper as disclosed in Japanese Patent Laid-open Publication Tokkaisho No. 58-52916, or another arrangement in which a microwave absorbing heat generating material is coated on a ceramic or glass container as disclosed in Japanese Patent Laid-open Publication Tokkaisho No. 58-52917.

However, the known arrangements as described above have such problems that uneven baking (or scorching) may take place or yeast for fermentation is undesirably killed if applied to the bread bakery, since microwaves are transmitted into the container. Due to uneven microwave distribution within the heating chamber, the temperature for heating the container is not uniform, thus resulting in irregular baking (i.e. scorching) of the bread.

Another disadvantage inherent in the conventional arrangement is such that, if the main container and the lid are made of metal, electric discharge takes place at the junction therebetween for undesirable fusing.

Meanwhile, in the conventional heating container for baking, for example, adapted to bake bread in a rectangular or square shape (so-called Pullman shape), an exclusive lid is provided for closing an upper opening of the heating container. In the kneading process and fermentation process for the manufacture of bread, the lid is removed for the processing, while during baking, the lid is mounted on the heating container to obtain the bread in the required shape.

However, in the known heating container for baking of the above described type, the baked bread is sliced through eye measurement, since it is provided with no marks or the like for slicing the square bread in uniform thickness, and thus, the thickness tends to differ from slice to slice.

SUMMARY OF THE INVENTION

Accordingly, an essential object of the present invention is to provide a heat generating container for a microwave oven or the like, which is capable of preventing uneven heating and transmission of microwaves, through a simple construction for reduction of cost, with substantial elimination of disadvantages inherent in the conventional heat generating containers of this kind.

Another object of the present invention is to provide a heating container for baking which is provided with a parching portion in its lid to form parched marks on the bread so as to serve as marks for slicing the bread.

A further object of the present invention is to provide a heat generating container of the above described type, which is capable of positively fixing its lid in a simple manner for preventing entry of microwaves into the container.

In accomplishing these and other objects, according to one aspect of the present invention, there is provided a heat generating container for use in a microwave oven, which includes a metallic main container, a metallic lid to be detachably applied onto such metallic main container, and microwave absorbing heat generating film layers formed on outer surfaces of said metallic main container and metallic lid.

The microwave absorbing heat generating film layer referred to above is prepared by a paint including 10 to 60% of resin having heat-resistance over 150° C. (silicon, epoxy, urethane, polyester resin, etc.) and ferrite powder, and a sealing material, or by a plasma spray coating or flame coating of ferrite and SiC. The outer surface of the microwave absorbing heat generating film layer is further covered by a microwave transmitting and heat-resistant paint (e.g., paint containing methylphenylsilicone resin, and ethylene tetrafluoride resin, polyether sulfone resin, polyphenyl sulfone resin or the like).

By the above arrangement of the present invention, since the metallic main container and lid are directly heated by the self-heat generation based on microwaves and the microwave absorbing heat generating film layer, high heating efficiency is available, and owing to the simple construction as compared with the arrangement of indirect heating, cost reduction may be achieved. The main container and lid made of metallic material are superior in heat conduction, thus reducing uneven heating, while they advantageously prevent microwaves penetration. Moreover, the microwave transmitting and heat-resistant coating protects the microwave absorbing heat generating film layer, while improving the appearance of the product.

Moreover, by providing a heat-resistant insulative packing between the joining faces of the main container and the lid, undesirable electrical discharge to be generated therebetween may be advantageously prevented.

In another aspect of the present invention, the heating container for baking is provided with a lid to close the upper opening of the heating container, with the parching portion being provided on said lid for forming parched marks serving a marking for slicing the bread into uniform thickness. In the above arrangement, the material after kneading and fermentation is subjected to baking, with the lid fixed to the heating container, and upon completion of the baking, the parched marks are formed by the parching portion of the lid so as to serve as the marking for slicing the bread into uniform thickness.

In a further aspect of the present invention, the heat generating container for a microwave oven formed with the microwave absorbing heat generating films on the outer surfaces of the metallic container and the lid is characterized in that rotary clamp levers each having a T-shaped cross section are pivotally provided at the upper side portion of the container, while on the upper surface of the lid, corresponding engaging covers which engage said rotary levers are provided to fix the lid through engagement thereof with said rotary levers, and thus, the heat generating container may be positively and tightly closed through simple construction.

Further scope of applicability of the present invention will become apparent from the detailed description given hereinafter. However, it should e understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become clear from the following description taken in conjunction with the preferred embodiments thereof with reference to the accompanying drawings which are given by way of illustration only, and thus are not limitative of the present invention, and in which.

DETAILED DESCRIPTION OF THE INVENTION

Figure 1:
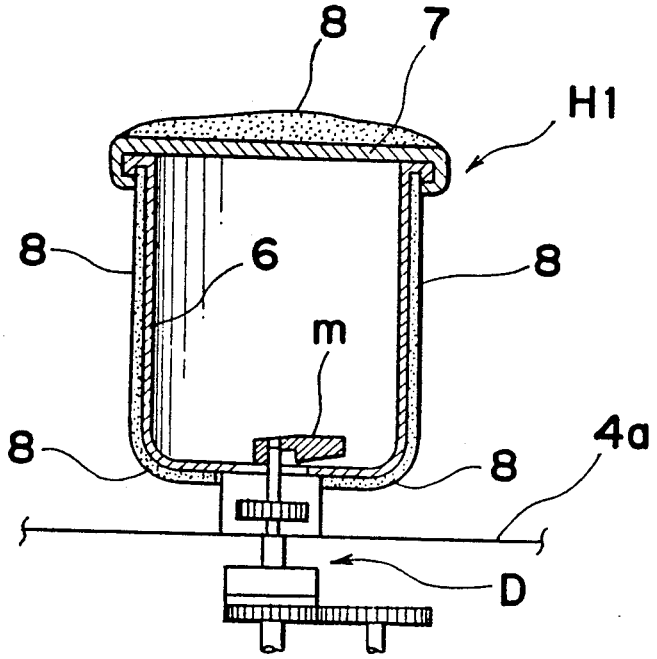
FIG. 1 is a schematic side sectional view showing a general construction of a bread baking container H1 according to a first embodiment of the present invention.

Before the description of the present invention proceeds, it is to be noted that like parts are designated by like reference numerals throughout the accompanying drawings.

Figure 3:
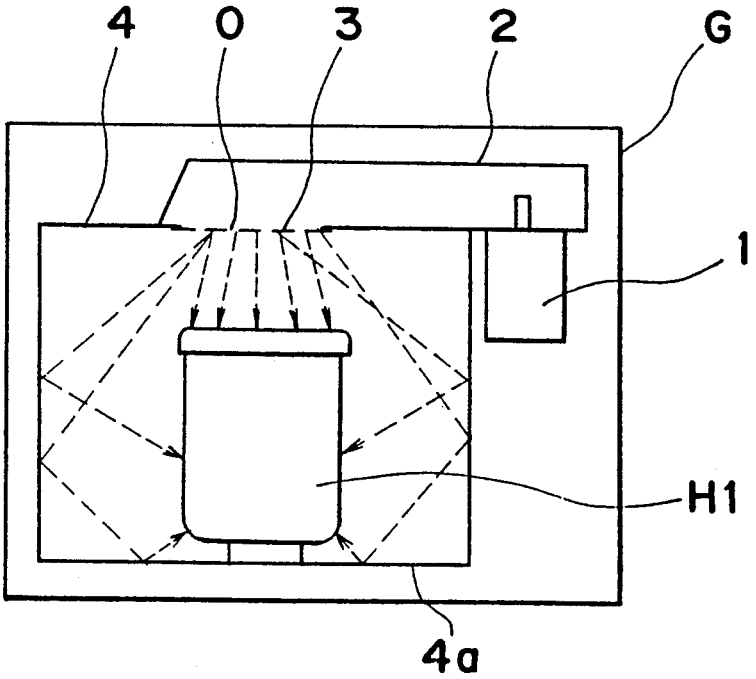
FIG. 3 is a schematic diagram showing a general construction of a microwave oven to which the bread baking container of FIG. 1 may be applied.

Referring now to the drawings, there is shown in FIG. 3 a schematic diagram illustrating a general construction of a single function microwave oven to which a heat generating container e.g. in the form of a bread baking container H1 according to one preferred embodiment of the present invention may be applied. In FIG. 3, the microwave oven includes a housing G in which a heating chamber 4 is defined, a magnetron 1 for emitting microwave energy, a waveguide 2 for leading microwave energy from the magnetron 1 into the heating chamber 4 through a waveguide cover 3 covering a feed opening 0 formed on a top wall of the heating chamber 4, and the bread baking container H1 directly related to the present invention and mounted on a bottom plate 4*a* within the heating chamber 4, with a kneading impeller m for the bread baking being rotatably provided at the bottom of the container H1 so as to be driven by a driving means D (FIG. 1).

As shown in FIG. 1, the bread baking container H1 generally includes a main container 6 and a lid 7 to be applied onto the main container 6. Both the main container 6 and the lid 7 are made of a metallic material which may shield microwaves and is a good conductor of heat, e.g., aluminum, aluminum alloy, stainless steel or the like. Over outer surfaces of the main container 6 and the lid 7, hard film layers 8, each of 100 to 300 microns in thickness, are formed by coating a microwave absorbing heat generating paint [e.g., a heat-resistant resin paint solution of silicone, epoxy or polyester group containing 40 to 90% (weight ratio) of iron oxide group ferrite powder (particle sizes in 1 to 10 μm) which efficiently absorbs microwaves], in the film thicknesses corresponding to strengths of the microwaves to be projected thereto. In the above embodiment, since the microwaves are irradiated onto the upper surface of the lid 7 in a strength two times that for the main container 6, the film thickness ratio between the main container 6 and the lid 7 is set at 2:1.

Figure 2:
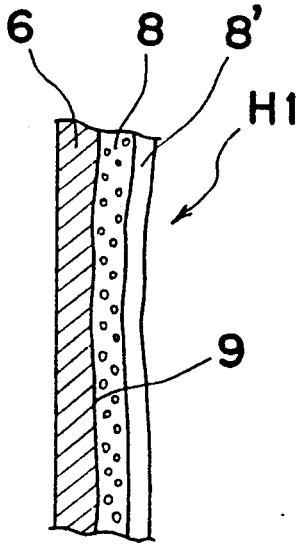
FIG. 2 is a fragmentary cross section showing on an enlarged scale, the structure of the wall for the bread baking container of FIG. 1.

With respect to the treatment of the ground of the container H1 for the coating, since the surface as it is obtained when a raw metallic plate is subjected to drawing or a raw material is molded by die casting, is inferior in the close adhesion of the painted coating, such surface is subjected to a primer treatment by a thin layer of a heat-resistant paint in several microns to several tens of microns after roughening the surface through sandblasting, or finished by a plasma spray coating of alumina, titania, or the like to be in such an undulated state as will reveal the ground. The resin paint containing ferrite is coated over the surface thus treated, thereby forming the hard film layer 8 as shown in FIG. 2.

In a single function microwave oven based only on the microwave irradiation (without any heater), and not arranged to effect uniform microwave irradiation by a turntable, stirrer fan or the like, it is preferable to form the main container 6 and lid 7 by a material having heat conductivity equal to or higher than aluminum. By way of example, when aluminum is used for the main container 6 and lid 7, in a series of baking processes including the charging of bread material into the container H1, mixing, kneading, fermentation by yeast, and baking, especially at a temperature range of 150° to 200° C., brown scorching is uniformly formed over the entire surface of the baked bread for delicious looking bread. When stainless steel of SUS 304 is employed, on the other hand, the scorching after baking is too light to be tasteful, due to the fact that the stainless steel is inferior to aluminum in the heat conductivity and does not generate heat in itself through absorption of microwaves, since it is of a non-magnetic material of austenite group.

Meanwhile, when the main container 6 and the lid 7 are constituted by stainless steel of SUS 430, they are inferior in the heat conductivity as compared with the main container and lid of aluminum as described above. However, even a single material of SUS 430 stainless steel effects the microwave absorbing heat generation to a certain extent owing to possession of magnetic characteristics, and therefore, if the microwave absorbing ferrite paint is used for the finishing in the similar manner as above, heat generation of the ferrite coating synergistically acts in addition to the microwave absorbing heat generation of the raw material by covering up the poor heat conductivity, thus forming excessive scorching through temperature rise to a level higher than that in the case of the aluminum container. In addition, since no microwave stirring devices such as the turntable, stirrer fan, etc. are employed, irradiation of microwaves is not uniformly effected around the entire periphery of the bread baking container. Furthermore, due to the fact that the stainless steel SUS 430 is poor in heat conductivity similarly as in SUS 304, the container prepared thereby is subjected to local heating, thus resulting in uneven scorching on the surface of the baked bread.

On the other hand, even in the single function microwave ovens, for a model provided with a turntable and/or a stirrer fan, stainless steel having the magnetic characteristics as in SUS 430 may be employed, since it is capable of effecting scorching formation by the uniform heating even if the heat conductivity is not higher than that of aluminum. However, with respect to stainless steel SUS 304 and plated steel plate such as aluminum plated steel plate, etc., it is difficult to deal with the situation by the ferrite paint. Accordingly, it becomes necessary to adopt a polymerization design by a cast item having a microwave absorbing heat generating power or ceramic SiC molded item and a heat insulating construction for preventing dissipation of heat out of the container.

The inner surfaces of the main container 6 and the lid 7 are subjected to a parting treatment of a fluorine coating by the ethylene tetrafluoride resin which is a known non-adhesive coating film or coating by silicon resin, PPS, and PES, etc. It is needless to say that an electromagnetic wave sealing treatment is required at the junction between the lid 7 and the main container 6 in order to prevent generation of sparking by the microwaves, and to protect the yeast from being killed by the microwave transmitted into the interior of the container 6 (for this purpose, conventional sealing technique may be adopted).

Since the coating film layer 8 containing 40 to 90% of ferrite is brittle and it is possible that such coating film layer 8 is detached due to formation of cracks by powder-like separation on the surface or deformation, the main container 6 and the lid 7 should be of molded items (press work, die-cast or casting) having a thickness not to deformed by external forces, e.g., in the range of about 1.5 to 5 mm. Moreover, for improving close adhesion of the coating film layer 8, the metallic surfaces of the container 6 and the lid 7 are subjected to surface roughening by degreasing, acid or alkali treatment, sand-blasting, etc., or ground finish such as formation treatment by chromating, anodic oxidation by alumite, etc. Furthermore, heat-resistant primer treatment for a still better adhesion may be effected, for example, by coating a methylphenylsilicone resin paint containing aluminum powder in a thickness less than 10 microns or rough surface is formed by uniformly dispersing ceramic flame spraying of alumina over a surface subjected to sandblasting. Otherwise, onto the treated surface subjected to the above ground treatment, in addition to the primary treatment and ceramic flame spraying, a methylphenylsilicone resin paint containing Fe group ferrite particles effective for electromagnetic wave shielding of a microwave oven by about 50 to 90% (weight ratio) is applied generally over the entire surface in the range of 100 to 500 microns, with subsequent baking at a temperature of 280° C. for 30 minutes, thereby forming a strong film bonded by silicone resin.

In addition, depending on necessity, as a top coat for maintaining soiling-resistance, close adhesion and tough film layer, a layer of methylphenylsilicone resin, ethylene tetrafluoride resin, polyether sulfone resin, or grey color of polyphenyl sulfone resin paint (paint film which allows microwaves to be transmitted therethrough) may be applied for finishing in thickness of about 20 to 100 microns, whereby impacts on the exposed surfaces, contamination by water or food articles, or deterioration by entry of such water or food articles can be prevented for long periods.

On the other hand, in the coating method also, it may be so arranged to process ferrite or SiC as it is into a layer with thickness in the range of 100 to 500 microns by plasma flame spraying in an inert atmosphere without employment of resin for an organic binder. Furthermore, in the material in which the microwave absorbing heat generating material is mixed with glass frit or other ceramic material such as $Al_2O_3$, $TiO_2$ or the like not transmitting microwaves besides ferrite and SiC in the range of 40 to 90% in concentration, the material containing proper concentration of the microwave absorbing heat generating material may be used to form plasma flame spraying films on the outer surfaces of the main container and the lid. In such flame spraying film, since the microwave absorbing heat generating material is melted into the ground metal for close adhesion to each other, problems related to separation of films, impacts and durability may be remarkably improved.

By using the heat generating container according to the first embodiment as described so far, bread baking was carried out through employment of a single function microwave oven with a power source of AC 60 cycles and an output of 500 W by effecting ON-OFF electronic control of microwaves in a known manner.

As a result, it was found that a coating of 80% ferrite containing silicone resin film layer 8 in the thickness of 400 microns was the most suitable for the main container 6, and a coating of 60% ferrite containing silicone resin film layer 8 in the thickness of 200 microns was the best for the lid 7, while a silicone resin paint in enamel color 8' (FIG. 2) containing ethylene tetrafluoride resin powder as applied in the thickness range of 20 to 100 microns was the best in durability for single units of the main container 6 and the lid 7. Meanwhile, as the metallic ground, the aluminum die-cast product subjected to plasma flame spraying 9 through porous dispersion of alumina after sand-blasting was favorable.

By the first embodiment of the present invention as described so far, a heat generating container for a microwave oven superior in the heating efficiency, with less heating irregularity can be provided at low cost, while said container may be used as a decorative component.

Figure 4:
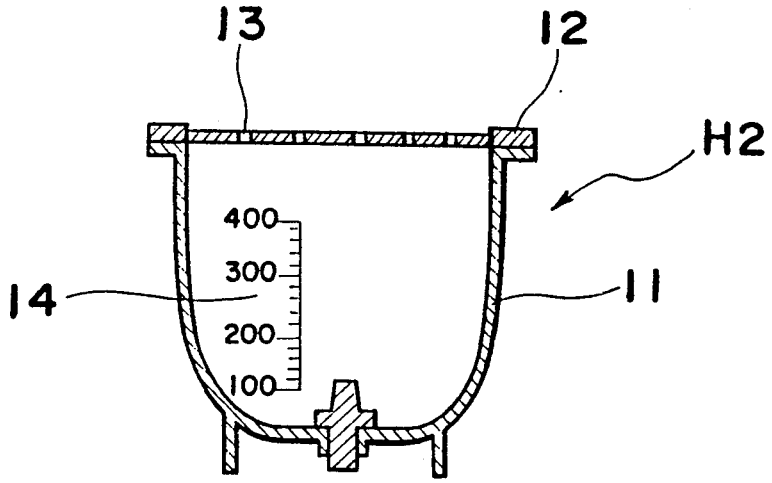
FIG. 4 is a view similar to FIG. 1, which particularly shows a general construction of a bread baking container H2 according to a second embodiment of the present invention.
Figure 5:
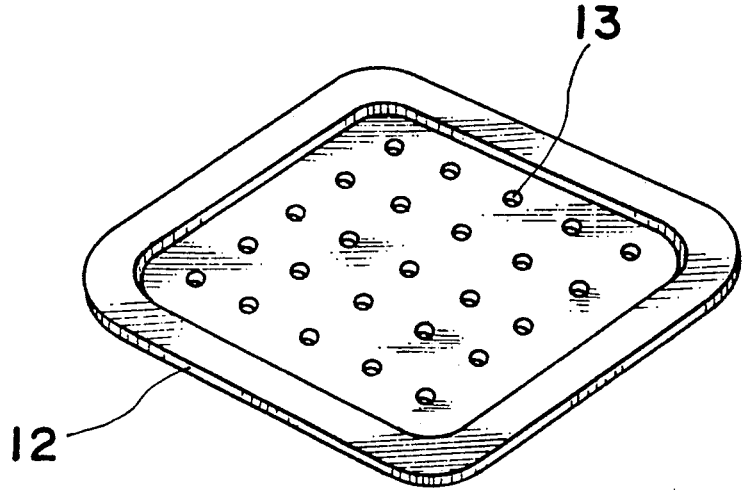
FIG. 5 is a perspective view, showing on an enlarged scale, the lid for the container of FIG. 4.

Referring further to FIGS. 4 and 5, there is shown a heating container H2 according to a second embodiment of the present invention, to be used, for example, for a bread baking machine, microwave oven or the like. The heating container H2 generally includes a main container 11, and a lid 12 for producing bread of a rectangular or square shape (so-called Pullman type), with said lid 12 being formed with many small holes 13 for allowing gas, moisture, etc. generated during kneading and fermentation of the bread materials, to escape therethrough.

The small holes 13 are, for example, provided in five rows longitudinally and laterally (FIG. 5) so as to divide one side of the lid 12 into six equal parts and thus, to slice the bread, for example, into six pieces in uniform thickness. As shown in FIG. 4, the main container 11 is provided with a scale 14 for measuring flour, butter, water or the like as the materials for the bread.

Upon starting of the bread baking process, with the materials such as flour, butter, water and the like being accommodated in the heating container H2, the processing proceeds in the order as in the kneading and fermentation, and gas, moisture, etc. generated in the course of the processing is discharged from the main container 11 through the small holes 13 formed in the lid 12.

After completion of the above step, the processing proceeds to the baking step to produce the square shaped bread, on the surface of which, traces of the small holes 13 remain as parched marks, and by slicing the bread along such parched marks of the small holes 13, the bread may be cut in uniform thickness.

Figure 6:
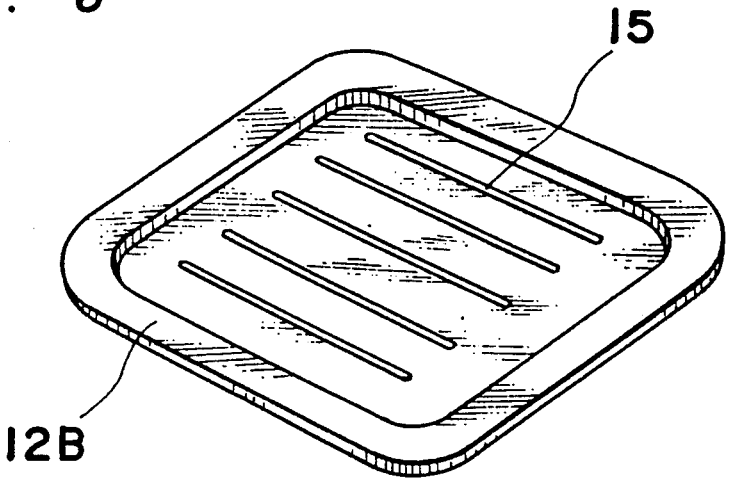
FIG. 6 is a view similar to FIG. 5, which particularly shows a modification thereof.

It should be noted here that in the above embodiment, although the small holes 13 are provided in the lid 12 as parching portion for forming parched marks as the marking for cutting the square bread into slices of uniform thickness (FIG. 5), such rows of small holes 13 may be replaced by linear cuts or slits 15 as in a modified lid 12B shown in FIG. 6 or by grooves or projections (not shown) provided on the reverse face of the lid 12.

It should also be noted that the parching portion as described above is not limited in its application, to the marking of the square bread as in the above embodiment alone, but may be readily modified, for example, as the parching portion by which round bread is to be radially cut uniformly, although not particularly shown here.

By the above arrangement of FIGS. 4 to 6, it becomes possible to readily cut the square bread into slices of uniform thickness.

Figure 7:
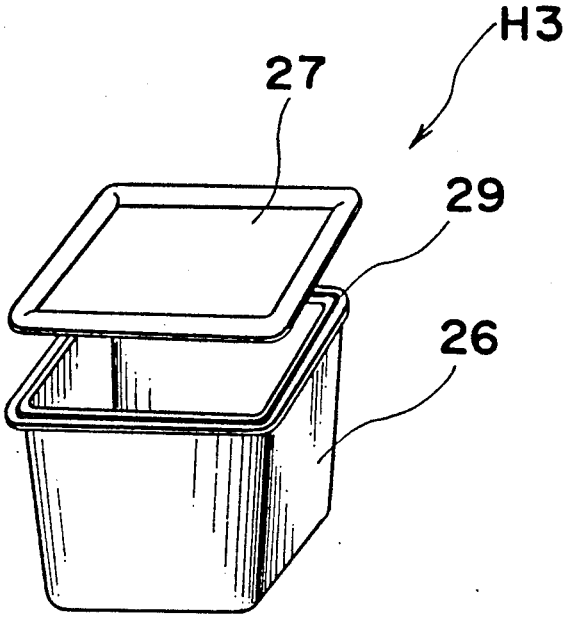
FIG. 7 is an exploded perspective view showing a general appearance of a bread baking container H3 according to a third embodiment of the present invention.
Figure 8:
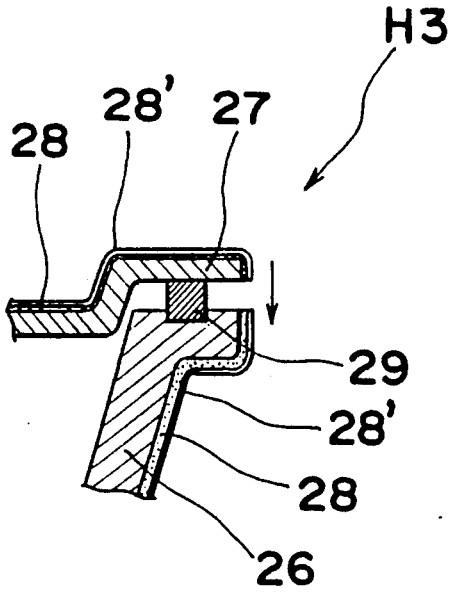
FIG. 8 is a fragmentary cross section showing construction of the bread baking container H3 of FIG. 7.

Reference is further made to FIGS. 7 and 8 showing a bread baking container H3 according to a third embodiment of the present invention, which may be applied to the microwave oven described earlier with reference to FIG. 3.

In FIGS. 7 and 8, the bread baking container H3 generally includes a main container 26, a lid 27 to be applied onto the main container 26, and an insulating packing 29 of silicone material disposed therebetween as shown. Both the main container 26 and the lid 27 are made of a metallic material which may shield microwaves and which are good conductor of heat, e.g., aluminum, aluminum alloy, stainless steel or the like. Over outer surfaces of the main container 26 and the lid 27, hard film layers 28, each of 100 to 300 microns in thickness, are formed by coating a microwave absorbing heat generating paint [e.g., a heat-resistant resin paint solution of silicone, epoxy or polyester group containing 40 to 90% (weight ratio) of iron oxide group ferrite powder (particle sizes in 1 to 10 $\mu$m) which efficiently absorbs microwaves].

Regarding the treatment of the ground of the container H3 for the coating, due to the fact that the surface as it is obtained when a raw metallic plate is subjected to drawing or a raw material is molded by die casting, is inferior in the close adhesion of the painted coating, such surface is subjected to a primer treatment by a thin layer of a heat-resistant paint in several microns to several tens of microns after roughening the surface through sand-blasting, or finished by a plasma spray coating of alumina, tintania, or the like to be in such an undulated state as will reveal the ground in the similar manner as in the container H1 in the first embodiment described earlier. The resin paint containing ferrite is coated over the surface thus treated, thereby forming the hard film layer 28 as shown in FIG. 8.

For a single function microwave oven based only on the microwave irradiation (without any heater), and not arranged to effect uniform microwave irradiation by a turntable, stirrer fan or the like, the main container 26 and lid 27 should preferably be formed by a material having heat conductivity equal to or higher than aluminum. By way of example, when aluminum is used for the main container 26 and lid 27, in a series of baking processes including the charging of bread material into the container H3, mixing, kneading, fermentation by yeast, and baking, especially at a temperature range of 150° to 200° C., brown scorching is uniformly formed over the entire surface of the baked bread for delicious looking bread. On the other hand, when stainless steel of SUS 304 is employed, the scorching after baking is too light to be tasteful, due to the fact that the stainless steel is inferior to aluminum in the heat conductivity and does not generate heat in itself through absorption of microwaves, since it is of a non-magnetic material of austenite group as was also stated with reference to the first embodiment of FIG. 1.

When the main container 26 and the lid 27 are constituted by stainless steel of SUS 430, they are inferior in the heat conductivity as compared with the main container and lid of aluminum as described above. However, even a single material of SUS 430 stainless steel effects the microwave absorbing heat generation to a certain extent owing to possession of magnetic characteristics, and therefore, if the microwave absorbing ferrite paint is used for the finishing in the similar manner as above, heat generation of the ferrite coating synergistically acts in addition to the microwave absorbing heat generation of the raw material by covering up the poor heat conductivity, thus forming excessive scorching through temperature rise to a level higher than that in the case of the aluminum container. In addition, since no microwave stirring devices such as the turntable, stirrer fan, etc. are employed, irradiation of microwaves is not uniformly effected around the entire periphery of the bread baking container. Furthermore, due to the fact that the stainless steel SUS 430 is poor in heat conductivity similarly as in SUS 304, the container prepared thereby is subjected to local heating, thus resulting in uneven scorching on the surface of the baked bread.

Even in the single function microwave ovens, for a model provided with a turntable and/or a stirrer fan, stainless steel having the magnetic characteristics to SUS 430 may be employed, since it is capable of effecting scorching formation by the uniform heating even if the heat conductivity is not higher than that of aluminum. However, with respect to stainless steel SUS 304 and plated steel plate such as aluminum plated steel plate, etc., it is difficult to deal with the situation by the ferrite paint. Accordingly, it becomes necessary to adopt a polymerization design by a cast item having a microwave absorbing heat generating power or ceramic SiC molded item and a heat insulating construction for preventing dissipation of heat out of the container.

The inner surfaces of the main container 26 and the lid 27 are subjected to a parting treatment of a fluorine coating by the ethylene tetrafluoride resin which is a known non-adhesive coating film or coating by silicon resin, PPS, and PES, etc. It is needless to say that an electromagnetic wave sealing treatment is required at the junction between the lid 27 and the main container 26 in order to prevent generation of sparking by the microwaves, and to protect the yeast from being killed by the microwave transmitted into the interior of the container 26 (for this purpose, conventional sealing technique may be adopted).

Due to the fact that the coating film layer 8 containing 40 to 90% of ferrite is brittle and it is possible that such coating film layer 28 is detached due to formation of cracks by powder-like separation on the surface or deformation, the main container 26 and the lid 27 should be of molded items (press work, die-cast or casting) having a thickness not to be deformed by external forces, e.g., in the range of about 1.5 to 5 mm. Moreover, for improving close adhesion of the coating film layer 28, the metallic surfaces of the container 26 and the lid 27 are subjected to surface roughening by degreasing, acid or alkali treatment, sand-blasting, etc., or ground finish such as formation treatment by chromating, anodic oxidation by alumite, etc. Furthermore, heat-resistant primer treatment for a still better adhesion may be effected, for example, by coating a methylphenylsilicone resin paint containing aluminum powder in a thickness less than 10 microns or rough surface is formed by uniformly dispersing ceramic flame spraying of alumina over a surface subjected to sandblasting. Otherwise, onto the treated surface subjected to the above ground treatment, in addition to the primary treatment and ceramic flame spraying, a methylphenylsilicone resin paint containing Fe group ferrite particles effective for electromagnetic wave shielding of a microwave oven by about 50 to 90% (weight ratio) is applied generally over the entire surface in the range of 100 to 500 microns, with subsequent baking at a temperature of 280° C. for 30 minutes, thereby forming a strong film bonded by silicone resin.

Moreover, depending on necessity, as a top coat for maintaining soiling-resistance, close adhesion and tough film layer, a layer of methylphenylsilicone resin, ethylene tetrafluoride resin, polyether sulfone resin, or grey color of polyphenyl sulfone resin paint (paint film which allows microwaves to be transmitted therethrough may be applied for finishing in thickness of about 20 to 100 microns, whereby impacts on the exposed surfaces, contamination by water or food articles, or deterioration by entry of such water or food articles can be prevented for long periods.

Furthermore, in the coating method, it may be so arranged to process ferrite or SiC as it is into a layer with thickness in the range of 100 to 500 microns by plasma flame spraying in an inert atmosphere without employment of resin for an organic binder. Furthermore, in the material in which the microwave absorbing heat generating material is mixed with glass frit or other ceramic material such as $Al_2O_3$, $TiO_2$ or the like not transmitting microwaves besides ferrite and SiC in the range of 40 to 90% in concentration, the material containing proper concentration of the microwave absorbing heat generating material may be used to form plasma flame spraying films on the outer surfaces of the main container and the lid. In such flame spraying film, since the microwave absorbing heat generating material is melted into the ground metal for close adhesion to each other, problems related to separation of films, impacts and durability may be remarkably improved.

Through employment of the heat generating container according to the embodiment as described above, bread baking was carried out through employment of a single function microwave oven with a power source of AC 60 cycles and an output of 500 W by effecting ON-OFF electronic control of microwaves in a known manner.

As a result, it was found that a coating of 80% ferrite containing silicone resin film layer 28 in the thickness of 300 microns was the most suitable for the main container 26, and a coating of 60% ferrite containing silicone resin film layer 28 also in the thickness of 300 microns was the best for the lid 27, while a silicone resin paint in enamel color 28' (FIG. 8) containing ethylene tetrafluoride resin powder as applied in the thickness range of 20 to 100 microns was the best in durability for single units of the main container 26 and the lid 27.

By the above embodiment of the present invention as described so far, a heat generating container for a microwave oven superior in the heating efficiency, with less heating irregularity, and intended to prevent transmission of microwaves and undesirable electric discharge at the junction between the container main body and lid may be provided at low cost.

Figure 9:
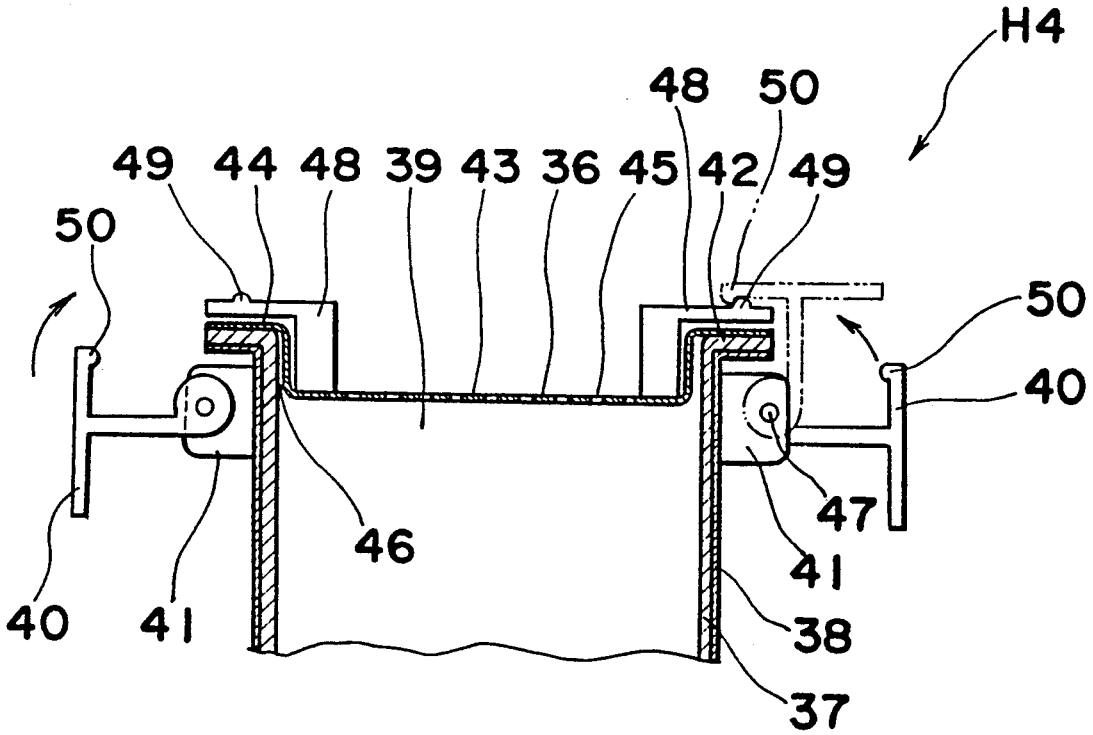
FIG. 9 is a fragmentary side sectional view showing construction of a heat generating container H4 according to a fourth embodiment of the present invention, especially illustrating the arrangement for fixing the lid by rotary levers on the container.
Figure 10:
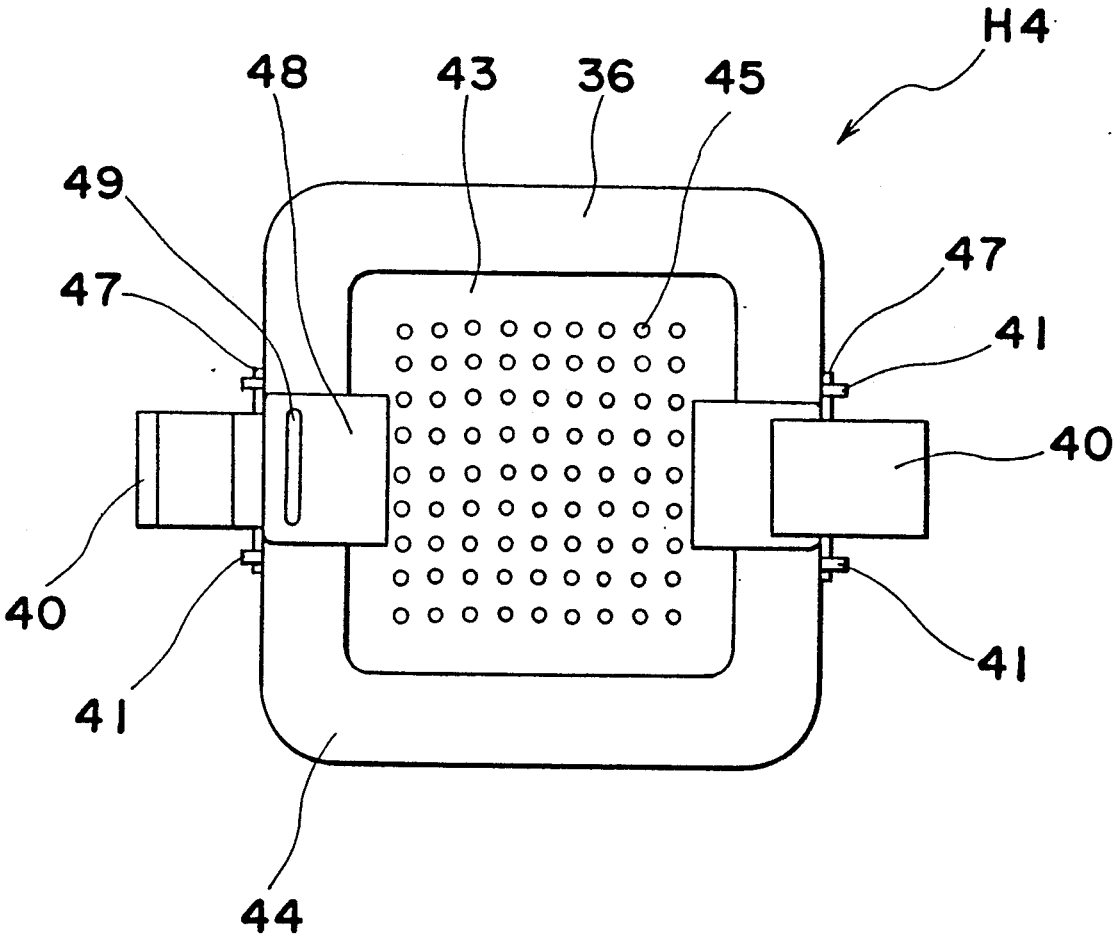
FIG. 10 is a top plan view of the heat generating container H4 of FIG. 9.

Referring further to FIGS. 9 and 10, there is shown a heat generating container H4 according to a fourth embodiment of the present invention, which generally includes a main container 37 made of a metal superior in heat conduction such as aluminum or the like, a metallic lid 36 to be detachably mounted onto the main container 37, and microwave absorbing heat generating film layers 38 formed on the outer surface of the main container 37 and the lid 36. The metallic main container 37 has an upper opening 39 surrounded by a flange portion 42 extending outwardly therefrom, a set of rotary clamp levers 40 each having a T-shaped cross section and pivotally mounted, through ribs 41, on the main container 37 in positions below and adjacent to the flange portion 42. The lid 36 generally having a U-shaped cross section includes a peripheral flange portion 44 and a recessed portion with a flat face 43 so as to be applied onto the main container 37 in a state where the peripheral flange portion 44 thereof contacts the corresponding flange portion 42 of the main container 37, with its recessed flat bottom 43 sinking into the opening 39 of said main container 37.

The flat bottom face 43 of the lid 36 is formed with many small holes 45 so as to prevent entry of the microwaves into the main container 37, and also, to allow steam or vapor produced during kneading and baking of the bread materials, to escape outside therethrough.

In order to permit activities of yeast for the sufficient fermentation of bread materials, it is absolutely necessary to prevent microwaves from entering the main container 37, and therefore, according to the present invention, the flange portions 42 and 44 are respectively provided on the main container 37 and the lid 36 to obstruct entry of microwaves by the contact therebetween at the junction, and moreover, clearance 46 is also provided between the inner wall of the main container 37 and the vertical wall of the lid 36 for attenuating the microwaves coming in by leakage at the flange portions.

Subsequently, the engaging portion between the lid 36 and the main container 37 will be described in detail hereinbelow.

The rotary clamp levers 40 pivotally provided on the opposite side face of the main container 37 each for rotation about the pivotal point 47 are intended to releasably fix the lid 36.

More specifically, on the lid 36 in positions to contact the rotary clamp levers 40, there are provided covers 48 made of a flexible material. On the upper surface of each cover 48, a protrusion or detent 49 having a semi-circular cross section is formed, while a clearance is provided between the cover 48 and the flange portion 44 of the lid 36.

Upon rotation of each rotary clamp lever 40 inwardly about the pivotal point 47 in a direction indicated by an arrow, a projection 50 formed at the forward edge of the lever 40 slightly contacts the protrusion 49 of the cover 48, and since the pivotal point 47 for the lever 40 is so set that a rotating locus of the protrusion 50 at this time becomes generally horizontal, when the clamp lever 40 is further rotated, the projection 49 of the cover 48 slightly deflects downwardly, and the projection 50 of the rotary clamp lever 40 passes over the protrusion 49 of the cover 48 so as to fixed the lid 36 in position.

For removing the lid 36, the rotary clamp levers 40 may be released in the order opposite to the above. With respect to inner pressures due to fermentation, and expansion, etc. of the bread materials, there is no possibility that the lid 36 is undesirably opened, since the direction of force acting on the lid 36 intersects at right angles with the direction of movement of the lever 40.

Moreover, the rotary levers 40 having the T-shaped cross section are useful also for carrying the container H4 when the lid 36 has been fixed thereby.

By the above construction, it becomes possible to effect bread baking without damaging yeast in the bread material.

Thus, the arrangement of the above embodiment which provides the shape of the main container and structure of the lid effective for baking bread by microwave energy without employment of electric heaters, has features as follows.

(1) The U-shaped cross section of the lid 36 having the flange portion 44 extending outwardly from its upper edge increases the contact area or contact length with respect to the main container 37, thereby preventing entry of microwaves into said main container (Otherwise, yeast may be killed by the entry of microwaves, and fermentation can not be fully effected).

(2) By forming the small holes 45 in the lid 36, extra steam or vapor is allowed to escape so as to prevent the bread material from becoming sticky.

(3) The arrangement to fix the lid 36 to the main container 37 through utilization of the protrusion 49 of the flexible cover 48 by turning the rotary lever 40 of the main container 37, advantageously prevents entry of the microwaves into said container.

(4) By the flexible covers 48 attached to the lid 36, the microwave absorbing heat generating layer on the lid is prevented from directly contacting the rotary clamp levers 40, and thus, the surface treatment is protected against any damages.

As is clear from the foregoing description, the lid for preventing entry of microwaves into the main container may be fixed readily and positively, and moreover, damage to the surface treatment of the lid at the portion where the rotary levers contact can be advantageously prevented, while in the state where the lid is fixed, the rotary levers may be utilized as handles for the container.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A bakery heating container for baking bread comprising a main container and a lid for closing an upper opening of said main container, said lid being provided with a parching portion including at least one opening for forming parching marks on the bread to serve as markings for slicing the bread in uniform thickness.

2. The bakery heating container as claimed in claim 1, wherein the parching portion includes rows of small holes regularly formed in said lid for forming said parching marks on the bread.

3. The bakery heating container as claimed in claim 1, wherein the parching portion includes a plurality of generally linear slits formed in said lid for forming said parching marks on the bread.

4. The bakery heating container as claimed in claim 1, wherein the container is used in a microwave oven and wherein the main container has microwave absorbing heat generating film layers formed on an outer surface thereof.

5. The bakery heating container as claimed in claim 1, wherein the container is used in a break baking machine and wherein the parching portion includes openings for escape of at least one of gas and moisture during making of the bread.

6. The bakery heating container as claimed in claim 1, wherein the main container has measuring indicia on a side thereof for measuring quantities of ingredients of the bread.

7. The bakery heating container as claimed in claim 1, wherein the lid has an outer periphery which is generally continuously engaged by the container, the outer periphery of the lid being generally in a plane.

8. The bakery heating container as claimed in claim 1, wherein the parching portion comprises a plurality of holes uniformly distributed through an area of the lid engageable with the bread, the plurality of holes being in a plurality of generally linear rows across the lid.

9. The bakery heating container as claimed in claim 1, wherein the parching portion comprises a plurality of slits uniformly distributed through an area of the lid engageable with the bread, the plurality of slits being in a plurality of generally linear rows across the lid.

10. A bakery heating container for baking bread in a microwave oven comprising a main container and a lid for closing an upper opening of said main container, said lid being provided with a parching portion including at least one opening for forming parching marks on the bread to serve as markings for slicing the break in uniform thickness, the main container has microwave heat generating film layers formed on an outer surface thereof, the main container further has measuring indicia on a side thereof for measuring quantities of ingredients of the bread.

11. The bakery heating container as claimed in claim 10, wherein the parching portion includes rows of small holes regularly formed in said lid for forming said parching marks on the bread.

12. The bakery heating container as claimed in claim 10, wherein the parching portion includes a plurality of generally linear slits formed in said lid for forming said parching marks on the bread.

13. The bakery heating container as claimed in claim 10, wherein the lid has an outer periphery which is generally continuously engaged by the container, the outer periphery of the lid being generally in a plane.

14. A bakery heating container for baking bread comprising a main container, a lid and means for uniformly marking the bread for slicing the bread in uniform thickness, the lid closing an upper opening of the main container and the means for marking being provided on the lid, the means for marking comprising parching portions including at least one opening uniformly distributed throughout an area of the lid engageable with the bread, the parching portions extending in a plurality of generally linear rows across the lid.

15. The bakery heating container as claimed in claim 14, wherein the lid has an outer periphery which is generally continuously engaged by the container, the outer periphery of the lid being generally in a plane.

16. The bakery heating container as claimed din claim 14, wherein the parching portions includes rows of holes regularly formed in the lid for forming the marks on the bread.

17. The bakery heating container as claimed in claim 14, wherein the parching portions include a plurality of generally linear slits formed in said lid for forming the marks on the bread.

18. The bakery container as claimed in claim 14, wherein the container is sued in a microwave oven and wherein the main container as microwave absorbing heat generating film layers formed on an outer surface thereof.

19. The bakery heating container as claimed in claim 15, wherein the container is sued in a bread baking machine and wherein the parching portions include openings for escape of at least one of gas and moisture during making of the bread.

20. The bakery heating container as claimed in claim 15, wherein the main container has measuring indicia on a side thereof for measuring quantities of ingredients of the bread.

* * * * *